United States Patent [19]

Flaherty et al.

[11] Patent Number: 4,713,850

[45] Date of Patent: Dec. 22, 1987

[54] PATIENT IMMERSION VESSEL AND SYSTEM

[75] Inventors: Patrick Flaherty, Peoria; Jon D. Bridgwater, Morton, both of Ill.

[73] Assignee: Morton Metalcraft Company, Morton, Ill.

[21] Appl. No.: 11,319

[22] Filed: Feb. 5, 1987

[51] Int. Cl.[4] ..... A47K 3/06

[52] U.S. Cl. ..... 4/585; 4/587; 4/592

[58] Field of Search ..... 4/585, 587, 592, 661, 4/573

[56] References Cited

U.S. PATENT DOCUMENTS

| | | | |
|---|---|---|---|
| 2,253,995 | 8/1941 | Baxter et al. | 4/587 X |
| 2,860,349 | 11/1958 | Blomqvist | 4/540 |
| 3,112,498 | 12/1963 | Hoffman | 4/585 |
| 3,246,346 | 4/1966 | Schmidt | 4/585 |
| 3,334,360 | 8/1967 | Hoxeng et al. | 4/585 |
| 3,373,451 | 3/1968 | Schmidt | 4/585 |
| 3,755,830 | 9/1973 | Johns | 4/585 |
| 3,800,336 | 4/1974 | Hoxeng | 4/587 |
| 4,305,165 | 12/1981 | Wall, Jr. | 4/585 |
| 4,577,354 | 3/1986 | Stratton | 4/585 |

*Primary Examiner*—Henry K. Artis

*Attorney, Agent, or Firm*—Allegretti, Newitt, Witcoff & McAndrews, Ltd.

[57] ABSTRACT

An improved portable bathing apparatus useful for washing toxic substances from a patient in a prone position includes a support platform mounted on a support frame, a circumferential rail with a sheet attached to the rail, the rail being movable between a position parallel with the table to a position above the table to define a vessel. Specialized liners may be positioned within the vessel for use when bathing a patient to wash toxic substances therefrom. A stretcher with a special stainless steel construction and configuration is provided for support of a patient within the vessel.

14 Claims, 7 Drawing Figures

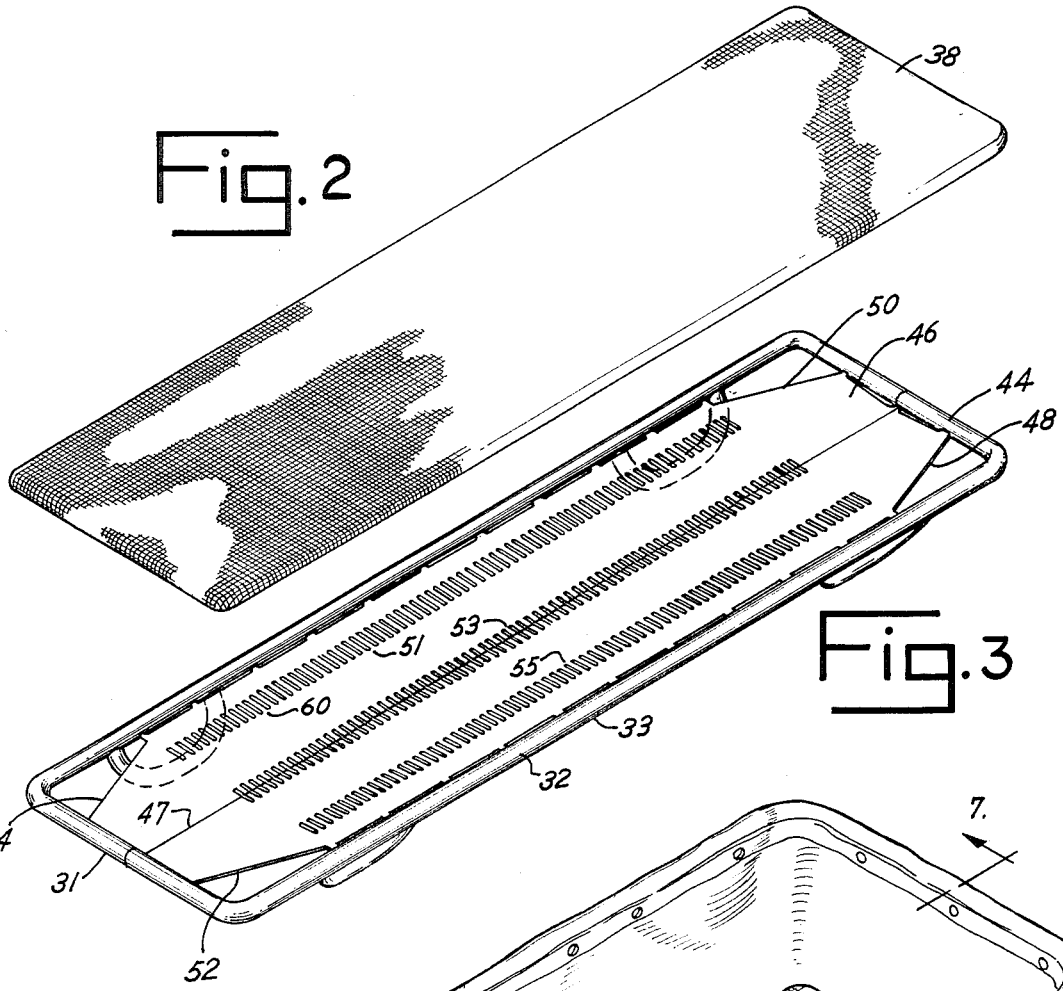
Fig. 2
Fig. 3
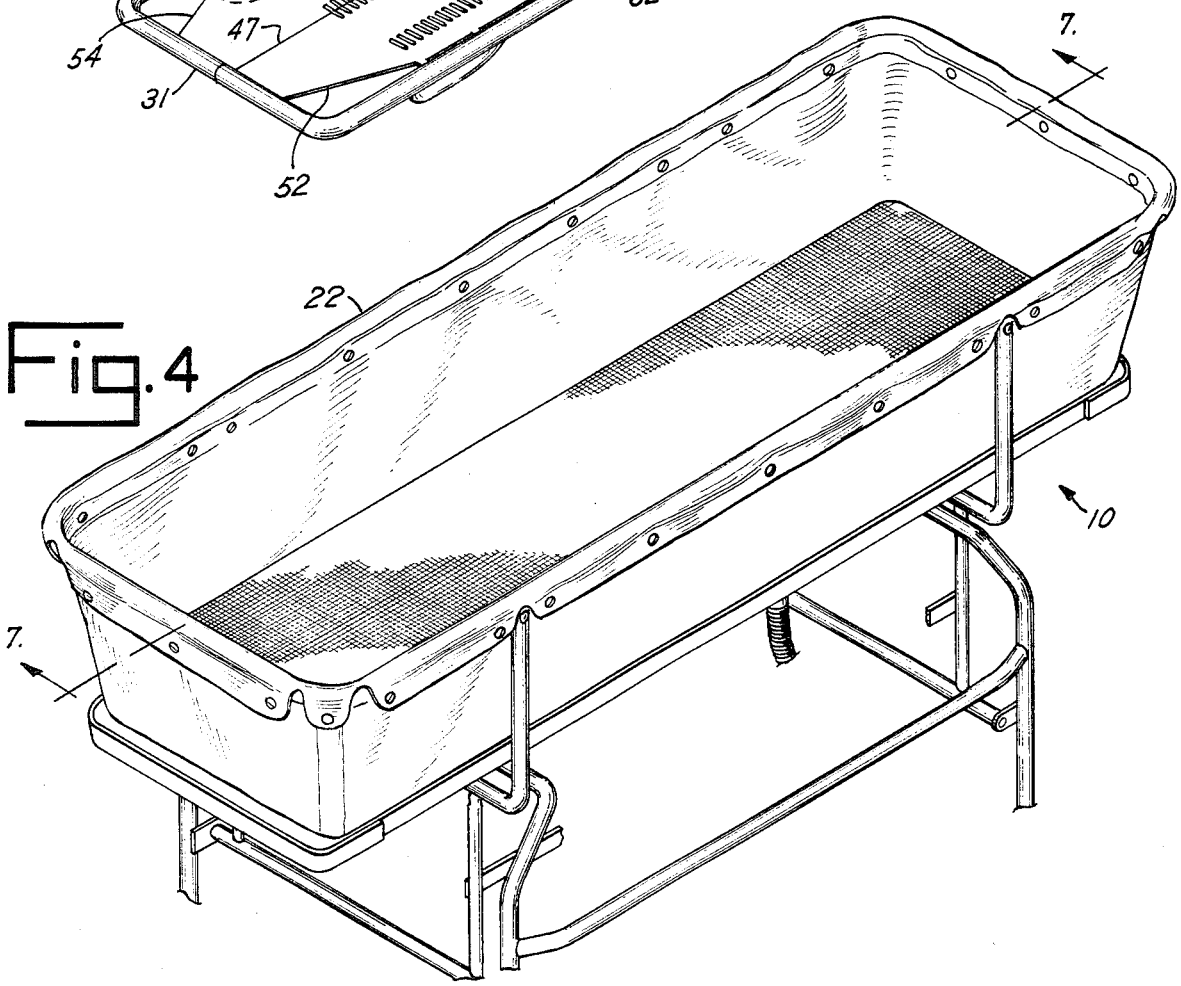
Fig. 4

PATIENT IMMERSION VESSEL AND SYSTEM

BACKGROUND OF THE INVENTION

This invention relates to improved portable bathing apparatus and stretcher assembly which, in combination, are particularly useful for the treatment and washing of patients exposed to toxic chemicals and radiation.

Portable bathing apparatus is available for use in hospitals and similar institutions. Typical of such apparatus is the device disclosed in U.S. Pat. No. 4,577,354 which is incorporated herewith by reference. The bathing apparatus depicted in U.S. Pat. No. 4,577,354 includes a table mounted on a dolly. A framework supports a flexible sheet on the table. The framework may be raised or lowered in order to form a vessel with the flexible sheet.

When a patient is to be bathed, the patient is positioned on the sheet on the table with the framework lowered. The framework and thus the flexible sheet is raised about the patient to define a vessel. The vessel is filled with water so that the patient may be cleansed. A drain at the bottom of the vessel may be used to drain the vessel after the patient is bathed so that the framework may then be lowered and the flexible sheet thus lowered. The bathed patient may finally be removed from the table or transported as necessary.

The described device is especially useful for a patient with water and soap bathing. However, there has remained a need to provide a system and apparatus for the cleaning of persons exposed to toxic chemicals and materials or external radiation. Such a device should preferably provide for immediate evacuation of all contaminated cleansing fluids to prevent the patient from being recontaminated due to an accumulation of the cleansing fluids that pass over the patient's body. Further, such a system should incorporate a stretcher to assist in patient movement. Such needs have led to the development of the present invention.

SUMMARY OF THE INVENTION

Briefly, the present invention comprises a portable table or platform mounted on a dolly. A flexible sheet supported by a framework or rail may be raised and lowered with respect to the table to define a vessel. A separate, fluid impervious liner is provided for the vessel. The liner includes a drain in the bottom for connection with a drain associated with the flexible outer sheet defining the vessel. A stainless steel stretcher of special construction is provided for placement on the platform and within the vessel. The stainless steel stretcher is formed from a circumferential, generally rectangular stainless steel tube with an internal stainless steel sheet forming a bed and thus defining a support surface for a patient on the stretcher. Hand holds are cut through the sheet at the four corners of the stretcher. Support legs are also positioned at the four corners of the rectangular tube forming the stretcher to support the stretcher above the platform.

The bed of the stretcher includes an array of slots to enhance draining of fluids from the stretcher. The bed of the stretcher is also shaped to further enhance draining of the fluids. An optional cover may be provided for fitting over the stretcher.

Thus, it is an object of the invention to provide an improved portable bathing apparatus especially useful for washing toxic substances from a patient.

A further object of the invention is to provide a portable bathing apparatus having a flexible sheet supported by a circumferential rail on top of a platform or table and further including a stretcher of special stainless steel construction for support by the table within the vessel.

Yet a further object of the invention is to provide a stainless steel stretcher construction having a unique configuration of slots and a unique cross section to enhance draining of fluids which flow over the body of a patient supported on the stretcher.

One further object of the invention is to provided an economical and easy to use apparatus for cleansing of persons exposed to toxic chemicals or materials or external radiation contamination.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 2 is a perspective view of a stretcher cover associated with a stretcher of the invention;

FIG. 3 is a perspective view of the stretcher associated with the apparatus of the present invention;

FIG. 4 is a perspective view of the assembled apparatus of the present invention with the vessel positioned about the stretcher;

DESCRIPTION OF THE PREFERRED EMBODIMENT

Figure 1:
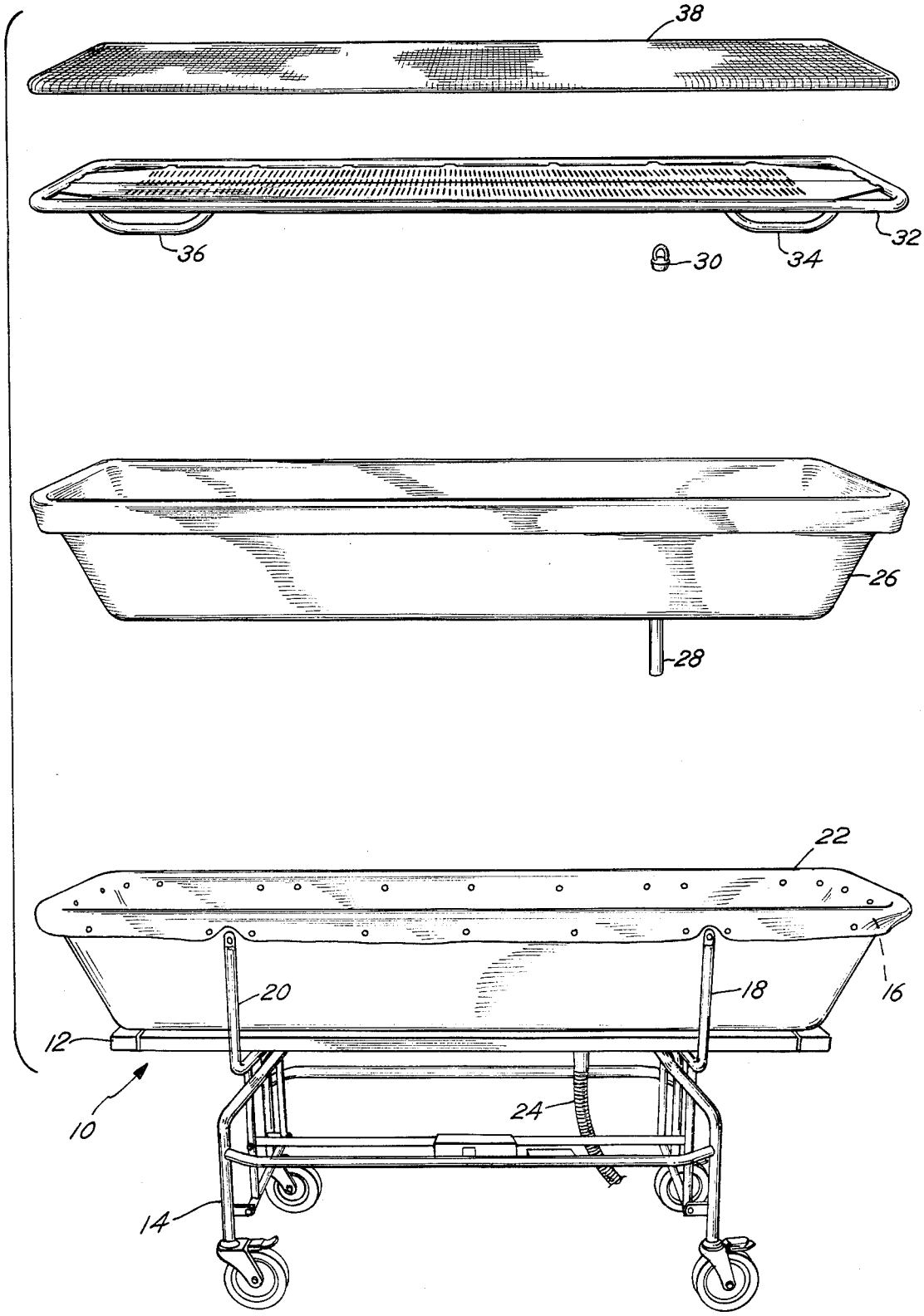
FIG. 1 is an exploded perspective view of the component parts comprising the portable bathing apparatus of the invention.

FIG. 1 depicts the component parts of the apparatus of the invention. Referring to FIG. 1, the apparatus includes a platform or table and sheet which are substantially identical to the assembly depicted in U.S. Pat. No. 4,577,354 incorporated herewith by reference. Thus, the assembly includes a platform or table 12 supported by a wheeled dolly or framework 14. A circumferential rail 16 is supported by frame members as at 18 and 20 which can be raised to support rail 16 above the table 12 and lowered so that the rail 16 will be substantially coplanar with the table 12. A fluid impermeable flexible sheet 22 is positioned over the rail 16 and supported by the rail 16. The sheet 22 when rail 16 is raised forms a vessel for immersion of a patient. A drain tube 24 leads from the bottom of the sheet 22 through an opening (not shown) in the table 12 for draining the contents of the sheet 22 when the sheet 22 is in the raised or assembled position as shown in FIG. 1.

As a second part of the apparatus of the present invention, a special liner of non-toxic, impermeable material 26 is fitted over the sheet 22. The liner 26 also includes a drain tube 28 and a removable plug 30. Liner 26 is sized to conform with the vessel formed by sheet 22. Liner 26 includes an elastic rim to facilitate maintaining the liner 26 fastened over rail 16. Alternatively, the rim may include fasteners to attach the liner 26 to sheet 22. Liner 26 as well as sheet 22 may be rectangular in shape.

A special strecther 32, which rests on support legs 34 and 36 in FIG. 1, fits within the vessel defined by the sheet 22 and liner 26. An optional stretcher cover 38 may be fitted over the stretcher 32.

Figure 7:
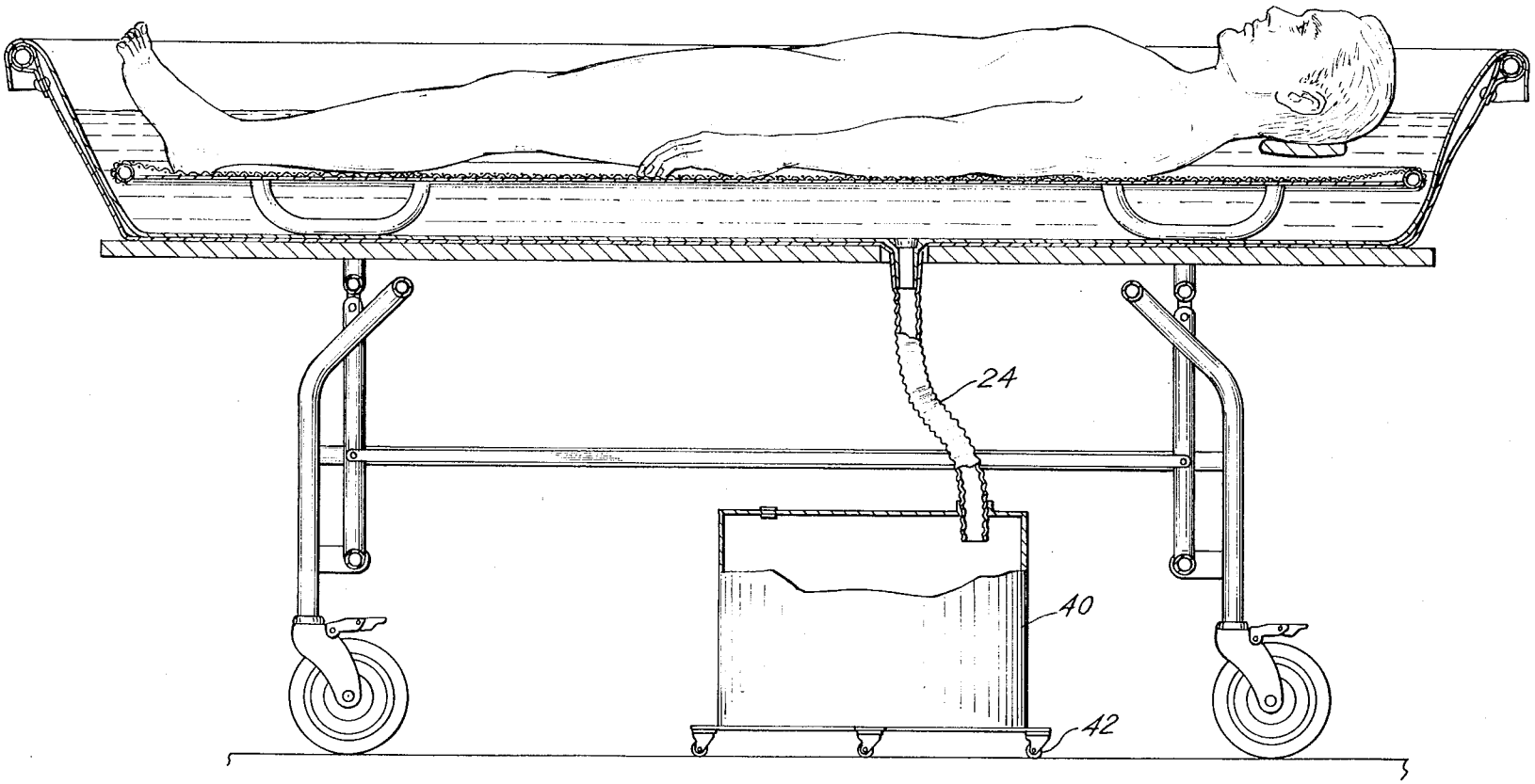
FIG. 7 is a side cross sectional view of the assembled apparatus of the invention illustrating the manner in which it is used for bathing a patient.

The assembly of FIG. 1 may be combined or arranged as shown in FIGS. 4 and 7 for immersion and bathing of a patient. For example, referring to FIG. 7, a patient who has been exposed to toxic fluids or toxic materials is supported on the stretcher 32 within the vessel defined by sheet 22. Fluid, which is used to cleanse the patient, is then flowed over the patient and drains through the stretcher 32 as well as the cover 38 for the stretcher. The wash fluid may then flow through the drain tube 24 into a special container 40 which receives the wash fluid and entrained toxic materials removed from the patient's body. Note that the container 40 is on rollers 42 and thus may be easily transported for purposes of decontamination or other disposal.

In practice, the patient may be lowered into the vessel defined by sheet 22. Alternatively, the table 12 and more particularly the rail 16 may be lowered. The stretcher 32 may then be placed on the table. The rail 16 may then be raised and the patient cleansed.

FIGS. 2, 3, 5 and 6 are referenced for their showing of the special construction features of the stretcher 32. Stretcher 32 is comprised of a generally rectangular shaped, stainless steel, closed loop tube 44. Positioned within the periphery of the tube 44 is a bed or plate formed of stainless steel. Bed 46 has a generally rectangular shape and conforms to the shape of the interior defined by the periphery of the tube 44. However, each of the corners of the bed 46 is cut out along cuts 48, 50, 52 and 54 so that hand holds are defined. Consequently, the tube 44 may be grasped easily by stretcher bearers either at the sides or at the ends of the stretcher 32. Note that the cuts 48, 50, 52 and 54 are at an angle to each corner of the generally rectangular bed 46 so that the tube 44 may be grasped either at the end 31 or at the longitudinal side 33 of the stretcher 32.

The bed 46 is comprised of a stainless steel plate which is welded at its periphery to the tube 44. The bed 46 defines a longitudinal axis 47 extending from the head to the foot of the stretcher 32. Slots, such as slots 60, are defined in the bed 46. The slots 60 extend generally transverse to the longitudinal axis 47 of the bed 46 and are arranged in parallel rows. The rows 51, 53, 55 are equispaced laterally and the slots 60 are equispaced longitudinally.

Figure 5:
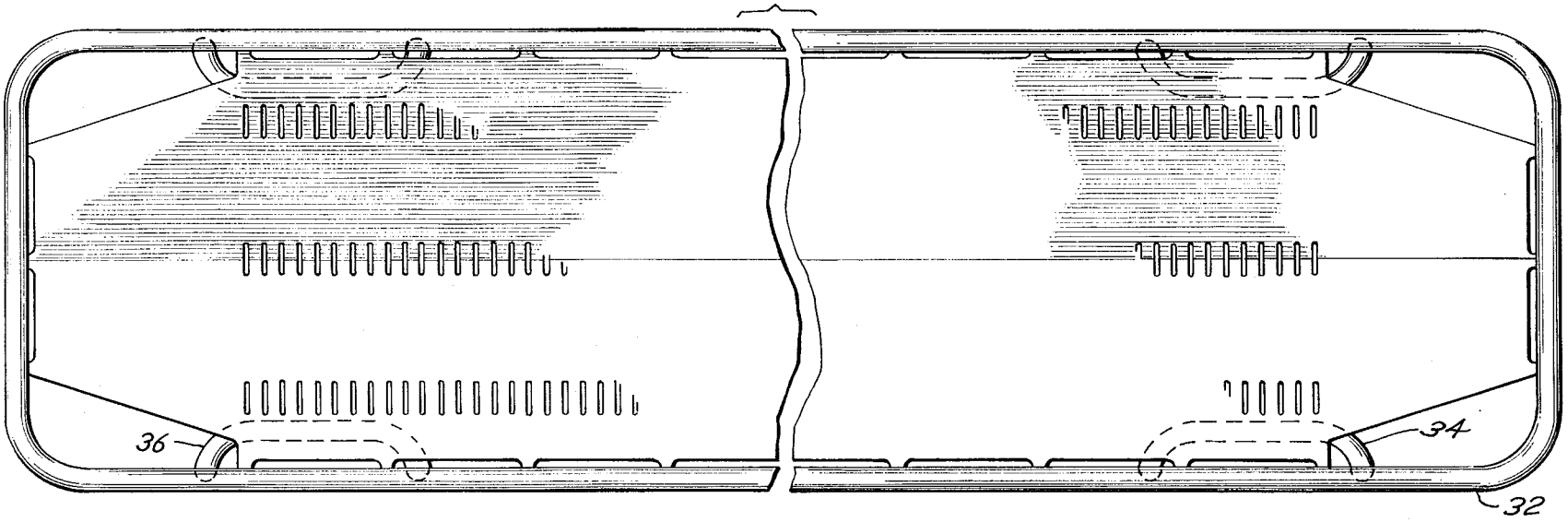
FIG. 5 is a top plan view of the stretcher of the invention.
Figure 6:
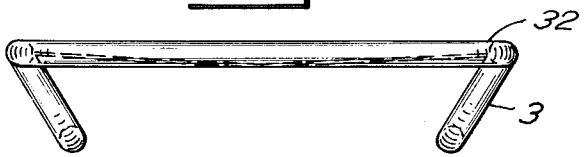
FIG. 6 is an end view of the stretcher associated with the apparatus of the invention.

The cross sectional shape of the bed 46 is illustrated in greater detail in FIG. 6. The bed 46 has a cross sectional shape which is defined as concave or V-shaped with the lower point of the V at the center line axis 47 of the bed 46 along the center line of stretcher. One series or row 53 of slots lies on that center line axis 47 as depicted in FIG. 5. This enhances the draining of fluids from a patient supported by the stretcher 32.

The supports for the stretcher 32, namely, supports 34 and 36, are U-shaped stainless steel supports welded to the tube 44 at each end and on each side of the tube 44. The U-shaped supports 34, 36 elevate the stretcher 32 approximately three to four inches above the table 12 when the stretcher 32 is resting upon the table 12. Note that the supports 34, 36 are inclined inwardly with respect to the circumferential tube 44 to ensure that the stretcher 32 is retained on the table 12 even though it might not be totally and properly aligned on the table 12.

The sheet 22, liner 26 and cover 38 may be manufactured from any of a number of inert fabric materials. It has been found that spun bonded olefins comprising fine polyethylene fibers coated with various materials such as polyethylene may be used for this purpose. The fabric or fiber may be made from other flame resistant and chemical resistant composite materials, for example the materials sold under the tradename "Challenge" manufacture by Chemical Fabrics Corporation.

When the apparatus of the present invention is used in practice, not only will the sheet 22, liner 26 or cover 38 be fabricated from the materials as designated, but also the persons who are giving the patient a bath can wear protective clothing of the same general nature. Coverall, hoods, boots and the like will be of the same or similar materials.

Once the patient is bathed and removed from the bathing assembly or apparatus of the invention, it is possible to remove and decontaminate or destroy all of the liner materials at a relatively nominal cost. Thus, decontamination of the assembly or apparatus of the present invention is greatly simplified due to its particular construction. The apparatus is self-contained, protable and requires no special plumbing fixtures for its use. It can immediately be refitted with new liners and covers for reuse. All disposable paraphernalia can be discarded easily particularly if contaminated. Not only may the apparatus of the present invention be used for highly specialized situations involving toxic materials, it may also be used in a normal situation wherein a patient requires normal bathing. Thus, the apparatus of the present invention can be used in a normal hospital situation as well as in a situation requiring emergency decontamination. Special decontamination facilities and apparatus are not necessarily required.

With the apparatus of the present invention, it is also possible to support a patient in a mesh sling from the rail 16 within the vessel defined by the sheet 22. It is also possible to vary the construction and composition of the fabric cover 38 for the stretcher in order to accommodate various types of emergency situations and the special needs of the patient who is being processed using the apparatus of the invention. Further, it may be possible to use a foam pad intermediate the cover 38 and the stretcher bed of the stretcher 32.

The use of a liner 26 in combination with a permanent sheet 22 enables quick replacement of the liner 26 in the assembly. Additionally, it is possible with such a construction to use lighter gauge liners 26 which have a lower cost, yet which provide the necessary lining characteristics for the particular toxic materials or other materials which are being used in the vessel. Thus, liners 26 may be chosen to accommodate the particular needs associated with the particular bath which is being undertaken.

Various other alternatives with respect to the arrangement of the liners, covers, and the construction of the stretcher are possible. Thus, while there has been set forth a preferred embodiment of the invention, it is to be understood that the invention is to be limited only by the following claims and their equivalents.

What is claimed is:

1. An improved portable bathing apparatus especially useful for washing of toxic substances from a human in a prone position, said apparatus comprising, in combination:

a support platform mounted on a support frame to define a generally horizontal table;

a circumferential rail for the table, with means attached to the rail for raising and lowering the rail between a position generally coplanar with the table and a position above the plane of the table;

a flexible, fluid impermeable sheet supported by the rail and defining a fluid vessel when the rail is raised, said vessel having a bottom supported by the table when the rail is in the raised position;

a flexible, fluid impermeable, detachable liner detachably supported by the rail on the inside of the vessel defined by the sheet;

a stainless steel stretcher supported on the platform inside the vessel, said stretcher supported by at least four elevating supports integral with the stretcher and depending from the stretcher, said stretcher including a horizontal stainless steel stretcher bed, said bed including a plurality of slots along the length of the bed, said stretcher also including a circumferential stainless steel tube surrounding the bed and attached thereto, said supports depending from the tube, whereby a patient may be supported on the stretcher in the vessel for immersion or washing therein.

2. The combination of claim 1 wherein the stretcher tube defines a generally rectangular shape having opposite ends defining the head and foot of the stretcher and said bed defines a generally concave trough, said bed connected along its edge to the tube, said bed including at least two hand sized openings at each end adjacent the tube whereby the tube may be manually grasped at each end for transport of the stretcher.

3. The combination of claim 1 wherein the liner comprises a single generally rectangular sheet of material having a plurality of fasteners around the edge thereof defining means for folding over the rail and fastening to catches.

4. The combination of claim 3 wherein the liner and sheet includes a drain opening and a drainage tube from the drain opening.

5. The combination of claim 1 wherein the slots in the stretcher bed comprise a series of elongate slots, each one transverse to the tube sides, said slots spaced along the length of the stretcher bed.

6. The combination of claim 1 including wheels supportably attached to the table.

7. The combination of claim 1 in combination with a drain tube assembly from the bottom of the liner through the sheet and table.

8. The combination of claim 1 including a flexible cover for the stretcher.

9. The combination of claim 1 wherein the stretcher defines a longitudinal axis extending from the head to the foot and wherein the slots in the stretcher bed include a plurality of longitudinal openings transverse to the longitudinal axis.

10. The combination of claim 9 wherein the slots of the stretcher lie along an axis midway between the sides of bed.

11. The combination of claim 9 wherein the slots of the stretcher are arrayed in generally parallel rows of slots transverse to the axis.

12. The combination of claim 1 wherein the circumferential tube for the stretcher is a closed generally rectangular loop and the supports each constitute a U-shaped tube connected at its opposite ends to the circumferential tube and extending in the direction of the length of the stretcher.

13. The combination of claim 2 wherein the circumferential tube of the stretcher is a closed, generally rectangular loop and wherein the bed is generally rectangular and coincides with the inside of the circumferential tube, said bed being attached to the tube along the periphery of the platform, said bed having each corner cut off to define the hand openings.

14. The combination of claim 1 wherein the bed of the stretcher has a generally V cross sectional shape transverse to the length of the stretcher to direct and channel fluid from the bed.

* * * * *